US006471057B1

(12) United States Patent
Bird

(10) Patent No.: US 6,471,057 B1
(45) Date of Patent: Oct. 29, 2002

(54) BEVERAGE CONTAINER IN A HOUSING

(75) Inventor: Darrell Bird, 7117 Atwell, Houston, TX (US) 77081

(73) Assignee: Darrell Bird, Houston, TX (US)

( * ) Notice: Subject to any disclaimer, the term of this patent is extended or adjusted under 35 U.S.C. 154(b) by 23 days.

(21) Appl. No.: 09/641,226

(22) Filed: Aug. 17, 2000

(51) Int. Cl.[7] ..... B65D 73/00
(52) U.S. Cl. ..... 206/457; 312/311
(58) Field of Search ..... 206/457; 312/9.47, 312/204, 310, 311, 322

(56) References Cited

U.S. PATENT DOCUMENTS 1,698,731 A * 1/1929 Otto
2,470,993 A * 5/1949 Kramer
2,484,776 A * 10/1949 Zent et al.
2,532,729 A * 12/1950 Millstein ..... 206/457
2,657,966 A * 11/1953 Brockway
3,930,702 A * 1/1976 Pichowicz ..... 312/245
3,942,669 A * 3/1976 Savage, Jr. ..... 312/245
3,986,610 A * 10/1976 Hawn ..... 206/457
4,052,114 A * 10/1977 Tung et al. ..... 312/245
D258,253 S * 2/1981 Bleakley ..... D6/154
4,582,372 A * 4/1986 Cooper ..... 312/322
D364,800 S * 12/1995 Drewes et al. ..... D9/310
5,588,725 A * 12/1996 Frank ..... 312/245

* cited by examiner

*Primary Examiner*—David T. Fidei
(74) *Attorney, Agent, or Firm*—Buskop Law Group, P.C.; Wendy Buskop

(57) ABSTRACT

A functional and decorative housing for a beverage container is disclosed in this invention. The decorative housing is provided with a mechanism for supporting a beverage container and safely withdrawing the beverage container from the housing. A decorative beverage container is described that is placed in the decorative housing.

1 Claim, 6 Drawing Sheets

BEVERAGE CONTAINER IN A HOUSING

FIELD OF INVENTION

The present invention relates to a decorative container for holding fluids and a decorative housing for the container, and in particular alcoholic beverages in a safe and decorative way.

BACKGROUND OF THE INVENTION

Often decorative containers for example like "Tequila Bottle Cover Set" (U.S. Pat. No. 378,195) containing expensive fluids like perfumes, alcohol are packaged in a way that obscures the beauty of the container, or such containers are placed on supports like tables, and bar counters where likelihood of accidental fall is quite high. The present invention discloses a decorative housing for the decorative container in which such containers can be safely placed and safely withdrawn yet their presentation enhances attractiveness of the fluid container.

SUMMARY

A functional and decorative housing for a beverage container is disclosed in this invention. The decorative housing is provided with a mechanism for supporting a beverage container and safely withdrawing the beverage container from the housing. The housing comprises a first floor plate; at least three wall plates that form three walls of a room and are attached the first floor plate. A roof plate is attached to the three wall plates to form a roof of the room. A doorplate is attached to at least one of the three wall plates to form a door of the room. In the alternative the door can be made of two plates to make it like a swinging door on a western saloon. A second floor plate is attached on the first floor plate. The second floor plate can safely slide in and out of the room guided by ridges on the second floor plate and grooves on the guiding plates.

DETAILED DESCRIPTION

Figure 1:
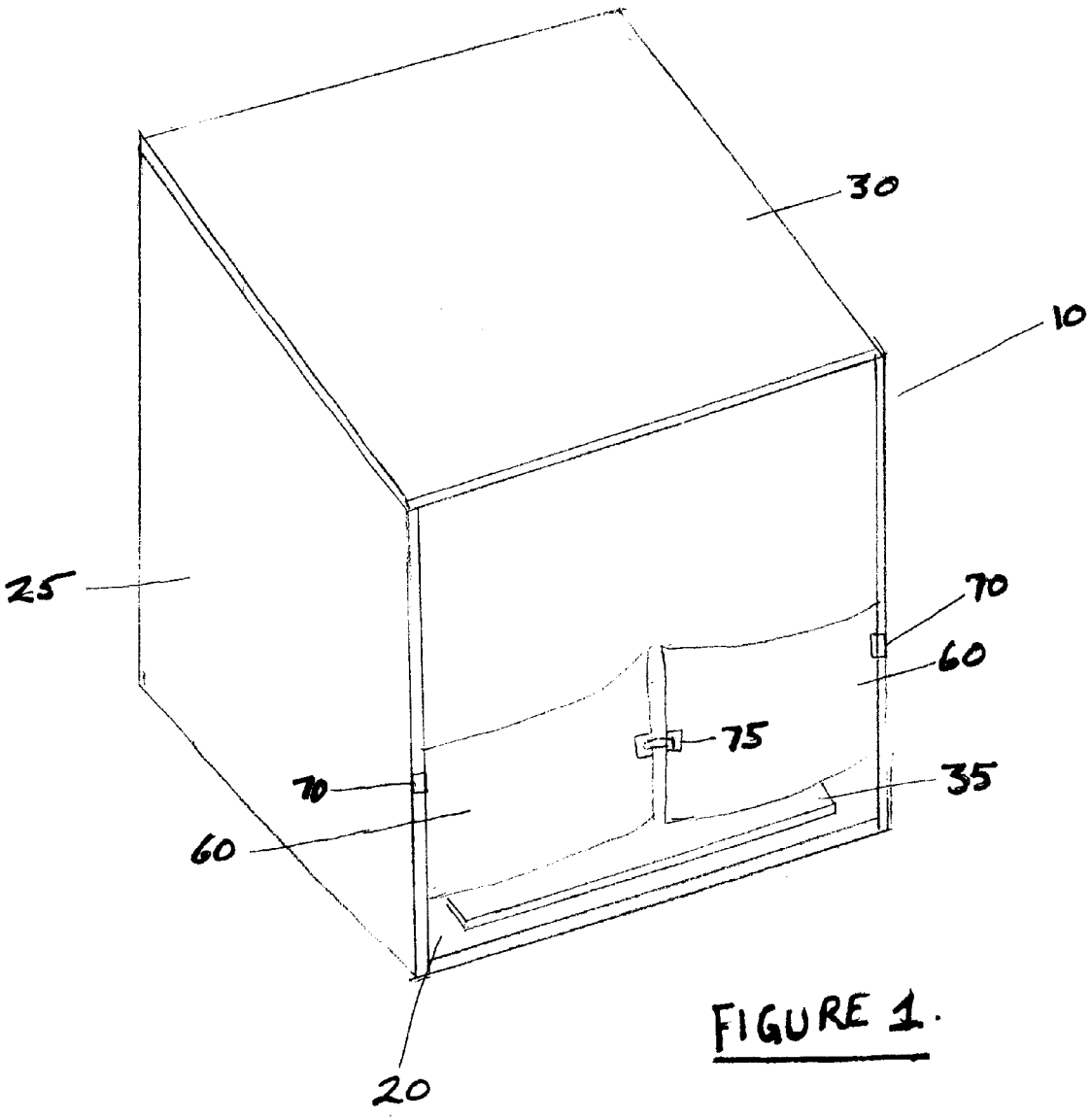
FIG. 1 shows an isometric view of the housing of the invention.
Figure 2:
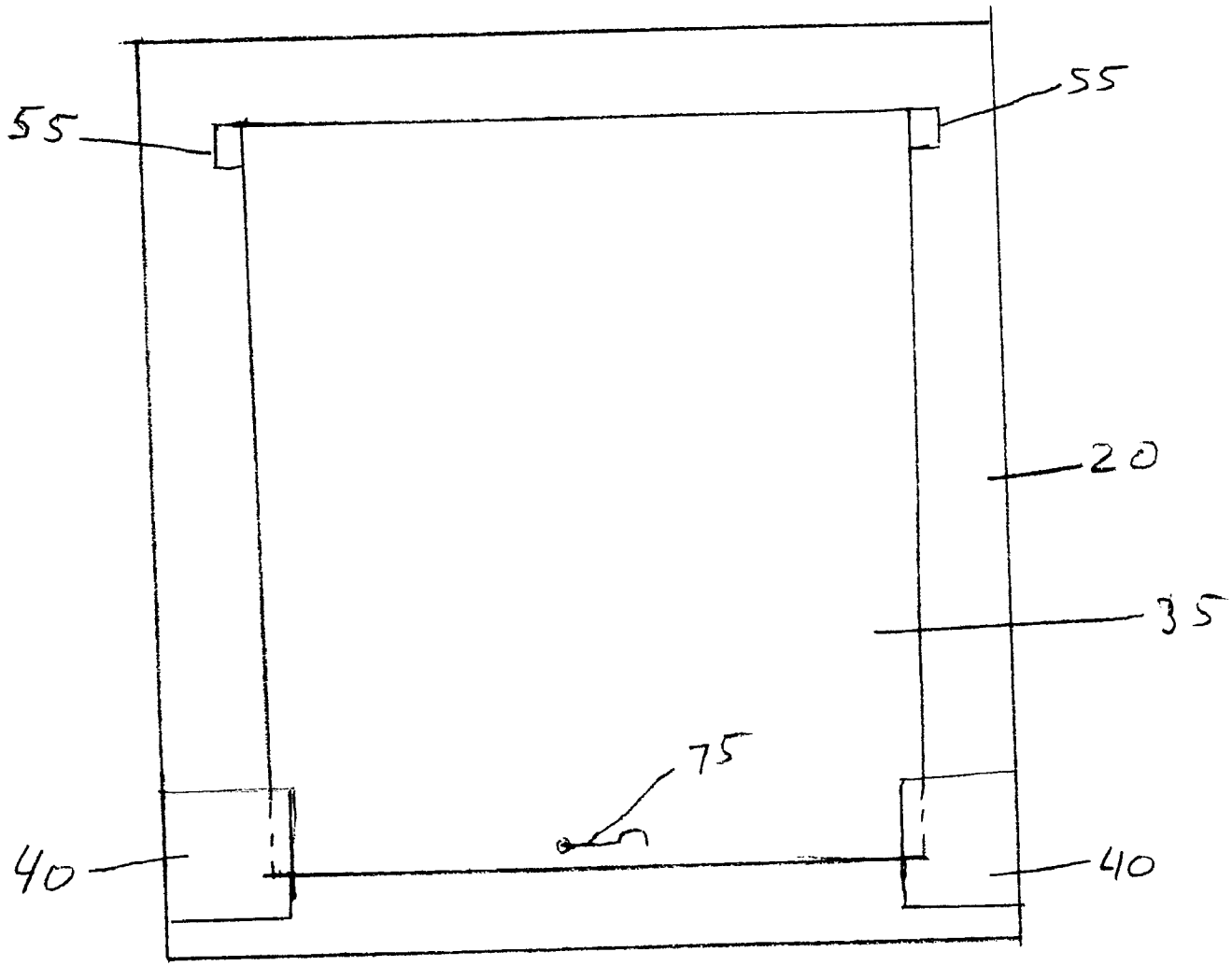
FIG. 2 is a plan view of the floor of the housing.
Figure 3:
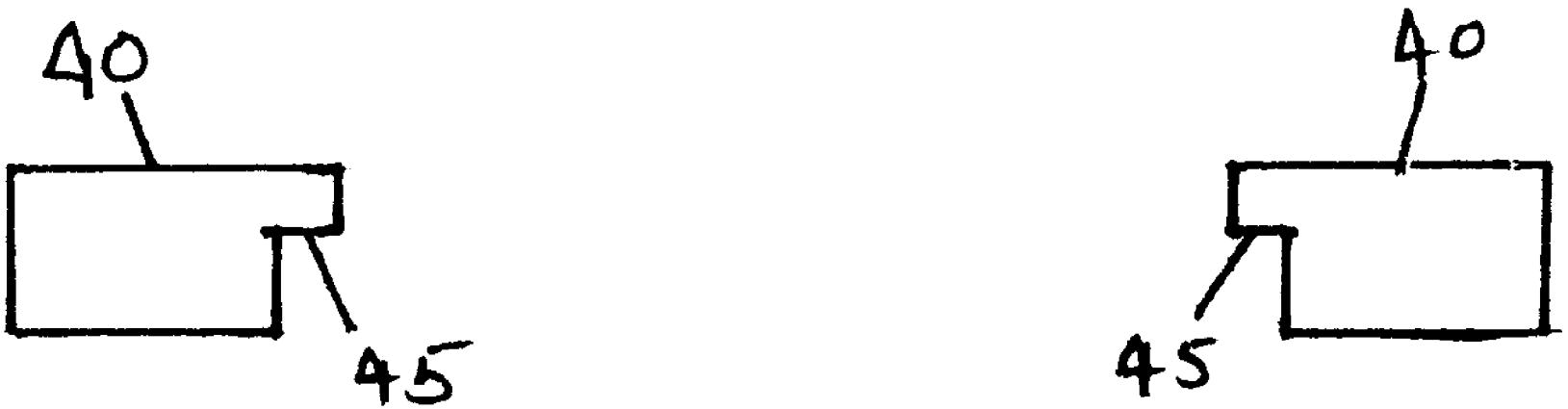
FIG. 3 shows the guiding means installed on the floor of the housing.

Referring to FIGS. 1–4, a housing (10) (also referred as room 10) has a first floor plate (20), at least three walls (25), a roof plate (30), at least one door plate (60), and a second floor plate (35) attached to the floor first plate (20) on which a decorative container can be placed. The floor first plate (20), the three wall plates (25), and the roof plate (30) form a room (10) like structure where the fourth wall is missing. The door plate (60) is attached to the room (10) where the fourth wall of the room (10) is expected; the door plate (60) only partially enclosing the fourth side of the room (10). The walls (25) can be painted, covered in tile, shingles, wall paper, fabric, posters, "wanted" posters or similar coverings. The housing (10) can be made from plastic, wood, ceramic, porcelain, fabric, or combinations thereof.

Figure 4:
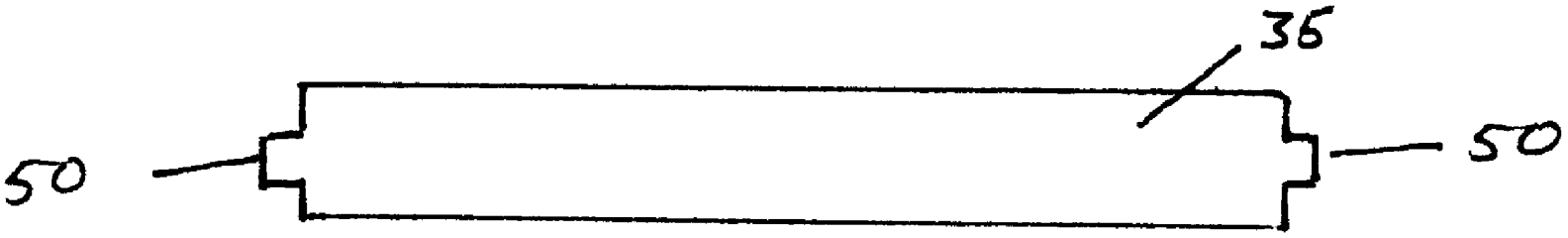
FIG. 4 shows ridges on the decorative container supporting plate that allow the supporting plate to safely enter and exit through the door of the room.

The first floor plate (20) is generally a rectangular plate sized to accommodate the second floor plate (35), and a decorative container placed the second floor plate (35). The second floor plate (35) is of a size smaller than the first floor plate (20) and is securely attached to the first floor plate (20) on the inside of the room (10). The second floor plate (35) is sized to fit on the first floor plate (20) such that it can easily slide in and out of the housing (10) and is also capable of supporting load of a filled decorative beverage container like a decorative bottle. The second floor plate (35) is provided with ridges (50), as shown in FIG. 4, along its two sides that are adjacent to the door. The second floor plate (35) is also provided with stops (55) on the interior end of the sides with ridges (50). The stops (55) are small rectangular plates of a size to fit on the second floor plate (35). Guiding means (40) are generally two rectangular plates with grooves (45) for guiding ridges (50) on the second floor plate (35). The guiding means (40) are attached on the first floor plate (20) near the door so that the second floor plate (35) can be guided in and out of the room (10) through the door. The stops (55) on the second floor plate (35) are such that when the second floor plate (35) is drawn out from the door, the stops (55) are obstructed by the guiding means (40) so that the second floor plate (35) can not be accidentally drawn out completely from the room (10), specially when an object like a decorative beverage container is placed on the second floor plate (35). A hook (75) is attached to second floor plate (35) near the center of its side near the door. The hook (75) serves dual purpose as being decorative as well as functional in that the person can pull the second floor plate (35) holding the hook (75). Other such decorative and functional substitutes for hook (75) could be a horseshoe shaped hook, a wreath shaped, or any decorative shaped hook.

The roof plate (30) is generally a rectangular plate that is connected to the at least three walls (25) to form a roof of the room (10). The at least three walls (25) can be rectangular in shape to give the roof a horizontal appearance, or can be appropriately sized so that the roof is inclined at an angle to give an appearance of a sloping roof.

The first floor plate (10), the at least three walls (25), the roof plate (30), the at least one door plate (60), and the second floor plate (35) are generally made of decorative wood. However, all components of the housing (10) can be made of ply wood, solid wood, polished or painted wood, polished metals, unpolished metals, plastics, materials with or without surface treatment, and combinations thereof. The roof can be terra cotta, Mexican tile, or painted to look like a tile roof.

The door can be made up of at least one doorplate (60) or can be made up of two pieces. The door is secured on one of the at least three wall plates (25) next to the door side of the room (10) by hinges (70) or similar means. If a two piece door is desired, two door plates (65) can be secured on two of the at least three walls adjacent to the door. Provisions can be made to put a small decorative lock (75) on the door. A saloon-style-swinging door is the most preferred door structure.

Figure 5:
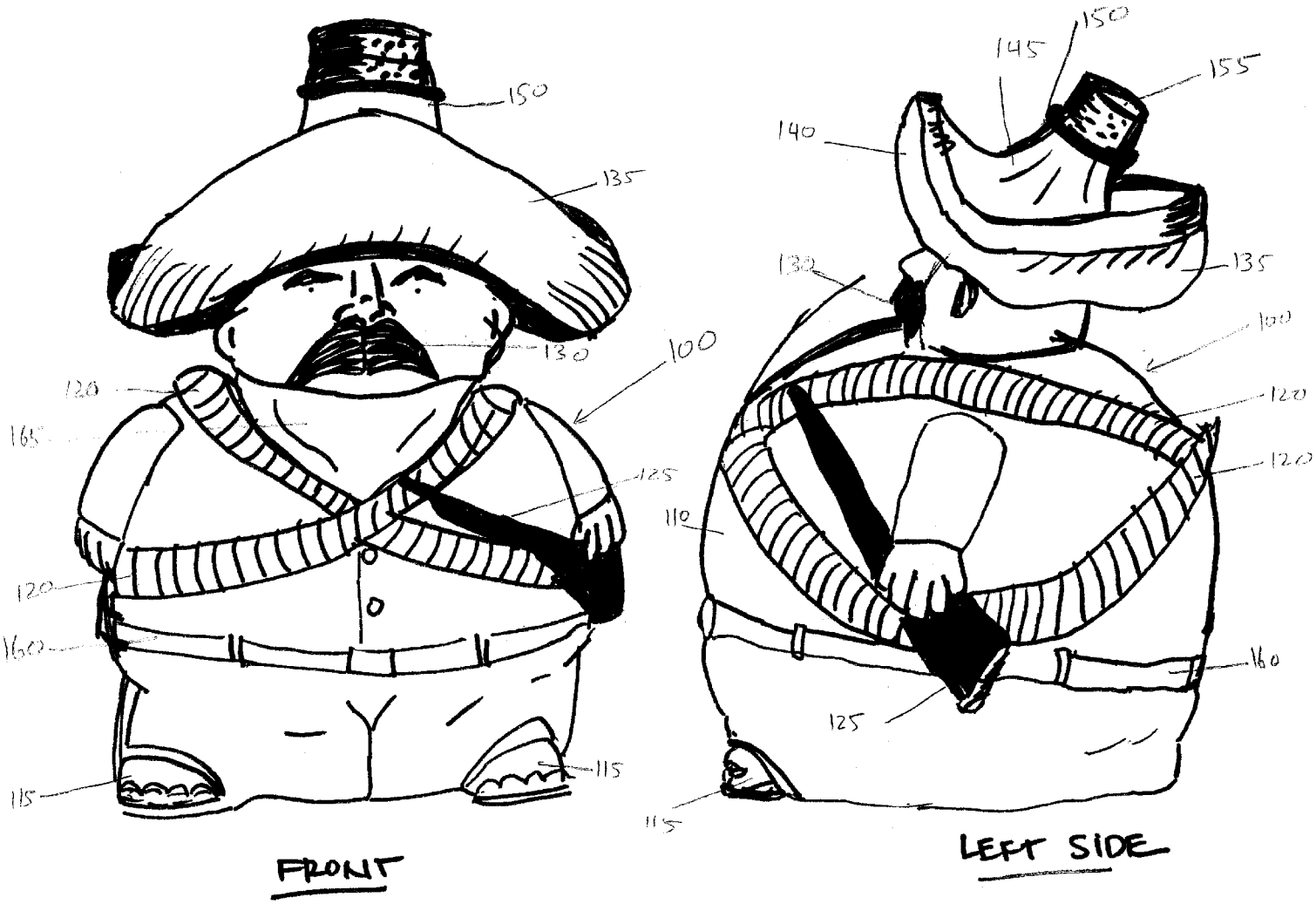
FIG. 5 shows the front view and the left view of the decorative beverage container.
Figure 6:
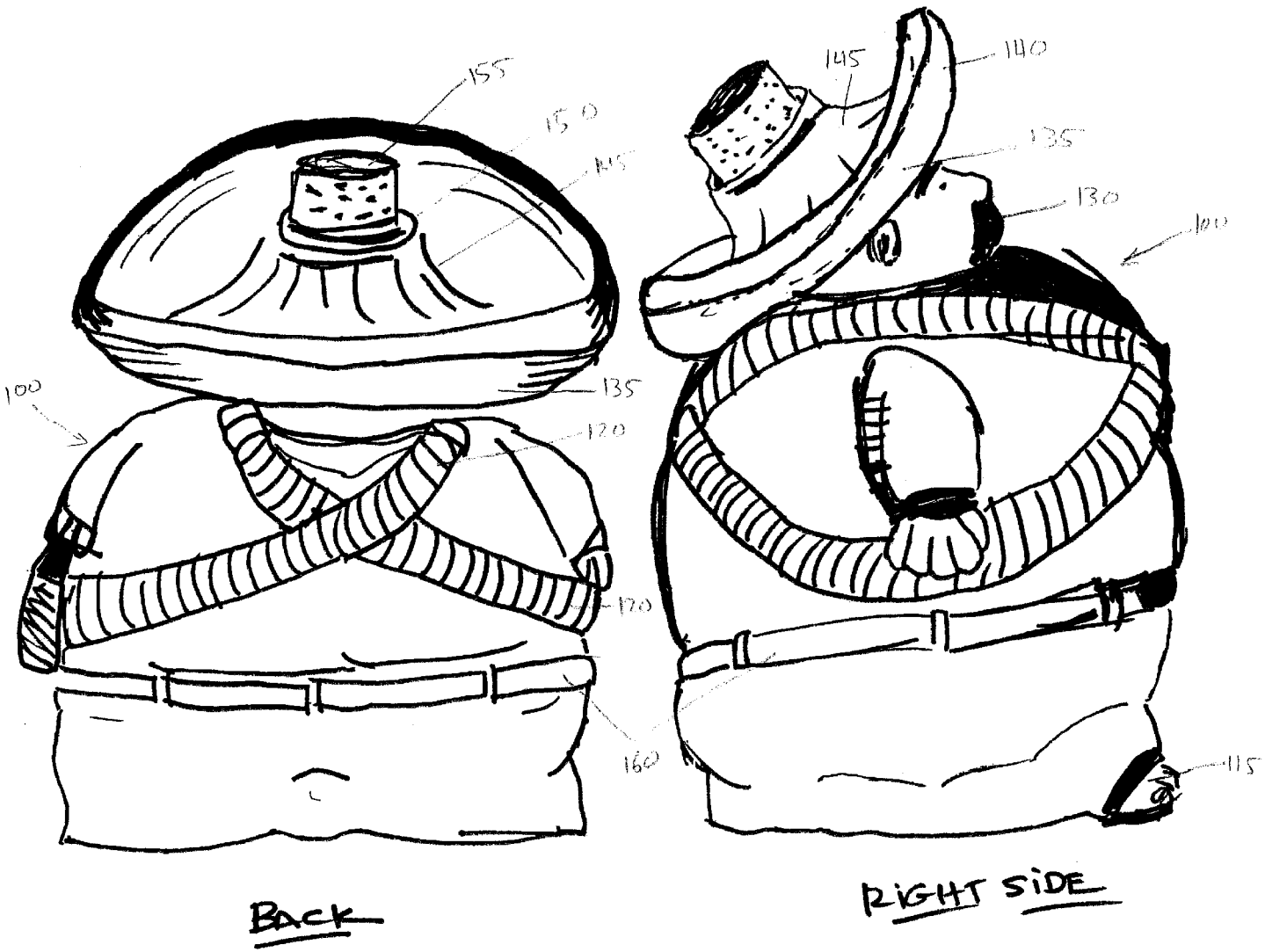
FIG. 6 shows the back view and the right view of the decorative beverage container.

FIG. 5 shows the front view and the left view of the decorative beverage container (hereafter container 100) and FIG. 6 shows the back view and the right view of the decorative beverage container (100). The beverage container or bottle can be a human or animal figure. The container (100) is made of porcelain, glass, or any suitable material for containing beverages. The container (100) is shaped like male person with a huge belly (110) extending from his neck (not seen) to feet such that interior of the belly (10) portion provides volume space for storing the beverage. The male person has two feet with slippers (115). The male person has gun ammunition cartridge belts (120) crossing around his neck and passing over lower part of his belly (110), and he is carrying a gun (125) in one hand. The male person has thick mustache (130) on his face, thick eyebrows, and a huge western hat (135) on his head, with all sides of the hat flaring upwards. The front portion of the hat (140) can be used for trademark description, beverage name and concentration described thereon. The male person is wearing a dark shirt and having a colorful scarf (165) around his neck. The central portion of the hat (145) flares upward to form a bottle neck and bottle opening (150) that can be closed with a cork (155), cap or a similar article. The male person is wearing a belt (160) around his belly (110).

In one embodiment of the housing (10, the first floor plate (20), the second floor plate (35), the roof plate (30), and the at least three wall plates (25) are made of aged appearing plywood. The first floor plate (20), the second floor plate (35), the roof plate (30), and one of the at least three wall plates (25) are made rectangular in shape. The roof on the housing (10) is made sloping towards the door side. Additional decorative plywood strips with grooves along the roof slope line are attached to the roof plate (30) in a slightly overlapping manner to enhance the decorative effect on the roof plate (30). In order to make a sloping roof over the housing (10), two of the at least three walls (25) are cut at an angle where they meet the roof plate (30) to form two identical trapezoids so that the roof plate (30) can become a sloping roof. The door of the housing (10) comprises of two doorplates (60) made of aged appearing plywood with decorative horizontal grooves, and the two doorplates (60) are cut to imitate swinging doors on a western saloon. The two doorplates (60) are hinged to two of the at least three wall plates (25) to form a swinging door of the housing (10). A set of lock latches (75) is provided on the two doorplates (60). The second floor plate (35) is smaller in size than the first floor plate (20), and is sized to fit on the first floor plate (20) along with the guiding means. The second floor plate (35) has ridges on two sides that are perpendicular to the closed door. In the preferred embodiment the second floor plate (35) is reinforced with two additional plates to increase the plate strength and decor value by changing the size of the reinforcing plates. The strengthening plates are not essential to the functioning of the invention. A saloon like sign with inscription "CANTINA" is placed on the front side (door side) touching the roof plate (30).

The bottle can be made from porcelain, ceramic, pottery, coated metal, metal, wood or combinations of these.

The bottle can contain any of a variety of beverages which are alcoholic, namely, beer, tequila, mescal, rum, vodka, bourbon, liquors, scotch and gin.

In the most preferred embodiment, the housing which can be referred to as the bottle presentation assembly can have side walls between six and eighteen inches high, a roof having a width of between six and twelve inches long and between six (6") and twelve (12") inches wide. The roof can be flat, peaked, arched or sloped in any of a variety of conventional roof shapes. The roof could include other ornamental features, such as a chimney. The housing could be constructed with a courtyard shape as well as the sold roofed structure and remain within the scope of the present invention.

What is claimed is:

1. A bottle presentation assembly comprising: at least one bottle containing an alcoholic beverage; and a decorative housing for slidably containing said bottle comprising: a first floor plate; a plurality of side walls connected to said first floor plate; a roof connected to said plurality of side walls; a second floor plate slidably connected to said first floor plate being adapted to slide from a first position surrounded by said side walls and under said roof to a second position external to said side walls and said roof, wherein said roof comprises a wood plate covered in terra-cotta tiles.

* * * * *